US007191128B2

(12) United States Patent
Sall et al.

(10) Patent No.: US 7,191,128 B2
(45) Date of Patent: Mar. 13, 2007

(54) METHOD AND SYSTEM FOR DISTINGUISHING SPEECH FROM MUSIC IN A DIGITAL AUDIO SIGNAL IN REAL TIME

(75) Inventors: Mikhael A. Sall, St. Petersburg (RU); Sergei N. Gramnitskiy, St. Petersburg (RU); Alexandr L. Maiboroda, St. Petersburg (RU); Victor V. Redkov, St. Petersburg (RU); Anatoli I. Tikhotsky, St. Petersburg (RU); Andrei B. Viktorov, St. Petersburg (RU)

(73) Assignee: LG Electronics Inc., Seoul (KR)

( * ) Notice: Subject to any disclaimer, the term of this patent is extended or adjusted under 35 U.S.C. 154(b) by 873 days.

(21) Appl. No.: 10/370,063

(22) Filed: Feb. 21, 2003

(65) Prior Publication Data

US 2003/0182105 A1 Sep. 25, 2003

(30) Foreign Application Priority Data

Feb. 21, 2002 (KR) ..... 10-2002-0009208

(51) Int. Cl.
*G10L 11/00* (2006.01)

(52) U.S. Cl. ..... 704/233; 704/208; 84/635

(58) Field of Classification Search ..... None
See application file for complete search history.

(56) References Cited

U.S. PATENT DOCUMENTS

| | | | | |
|---|---|---|---|---|
| 6,556,967 | B1 * | 4/2003 | Nelson et al. | 704/233 |
| 6,785,645 | B2 * | 8/2004 | Khalil et al. | 704/216 |
| 2002/0005110 | A1 * | 1/2002 | Pachet et al. | 84/635 |
| 2006/0015333 | A1 * | 1/2006 | Gao | 704/233 |

* cited by examiner

*Primary Examiner*—Abul K. Azad
(74) *Attorney, Agent, or Firm*—Fleshner & Kim, LLP

(57) ABSTRACT

The present invention relates to method and system for distinguishing speech from music in a digital audio signal in real time. A method for distinguishing speech from music in a digital audio signal in real time for the sound segments that have been segmented from an input signal of the digital sound processing systems by means of a segmentation unit on the base of homogeneity of their properties, comprises the steps of: (a) framing an input signal into sequence of overlapped frames by a windowing function; (b) calculating frame spectrum for every frame by FFT transform; (c) calculating segment harmony measure on base of frame spectrum sequence; (d) calculating segment noise measure on base of the frame spectrum sequence; (e) calculating segment tail measure on base of the frame spectrum sequence; (f) calculating segment drag out measure on base of the frame spectrum sequence; (g) calculating segment rhythm measure on base of the frame spectrum sequence; and (h) making the distinguishing decision based on characteristics calculated.

17 Claims, 8 Drawing Sheets

Fig. 6

Table A1. Decision table for speech/music discrimination

| # | C1 | C2 | C3 | C4 | Conclusion |
|---|---|---|---|---|---|
| 1 | $n < n_{short}$ | | | | SHORT_SEGM<br>EndAnalysis |
| 2 | $k_R > k_sc$<br>&& $R >= R_{def}$ | | | | MUSIC_TYPE<br>EndAnalysis |
| 3 | $T_{speech\ def} < T$ | | | | SPEECH_TYPE<br>EndAnalysis |
| 4 | $T_{speech} < T < T_{speech\ def}$ | | | | |
| 5 | | $D >= D_{up\ def}$ | | | MUSIC_TYPE<br>EndAnalysis |
| 6 | | $D > D_{low}$<br>&& $R >= R_{med}$ | | | MUSIC_TYPE<br>EndAnalysis |
| 7 | | $R >= R_{up}$<br>&& $N >= N_{low}$ | | | MUSIC_TYPE<br>EndAnalysis |
| 8 | | $D_{up} < D < D_{up\ def}$ | | | MUSIC_SPEECH<br>EndAnalysis |
| 9 | | !EndAnalysis | | | SPEECH_TYPE<br>EndAnalysis |
| 10 | $T_{music} < T < T_{speech}$ | | | | |
| 11 | | $D >= D_{up\ def}$ | | | MUSIC_TYPE<br>EndAnalysis |
| 12 | | other case | | | |
| 13 | | | $R > R_{med}$ | | MUSIC_TYPE<br>EndAnalysis |
| 14 | | | other case | | Not EndAnalysis |
| 15 | $T_{music\ def} < T < T_{music}$ | | | | |
| 16 | | $D < D_{low}$ | | | |
| 17 | | | $k_R > 0$ | | |
| 18 | | | | $R > R_{med}$ | MUSIC_TYPE<br>EndAnalysis |
| 19 | | | | other case | SPEECH_TYPE<br>EndAnalysis |
| 20 | | | other case | | SHORT-UNDETER_TYPE<br>EndAnalysis |
| 21 | | $N > N_0$<br>&& $R < R_{low}$<br>&& $H < H_0$ | | | NOISE_TYPE<br>EndAnalysis |
| 22 | | !EndAnalysis | | | MUSIC_TYPE<br>EndAnalysis |
| 23 | $T < T_{music\ def}$ | | | | |
| 24 | | $D > D_{up\ def}$<br>&& $N < N_0$<br>&& $H < H_1$ | | | NOISE_MUSIC_TYPE<br>EndAnalysis |
| 25 | | $R < R_{low}$<br>\|\| $H < H_1$ | | | MUSIC_TYPE<br>EndAnalysis |
| 31 | | $N >= N_0$<br>&& $R < R_{low}$<br>&& $H < H_0$ | | | NOISE_TYPE<br>EndAnalysis |
| 33 | !EndAnalysis | | | | UNDETER_TYPE<br>EndAnalysis |

METHOD AND SYSTEM FOR DISTINGUISHING SPEECH FROM MUSIC IN A DIGITAL AUDIO SIGNAL IN REAL TIME

BACKGROUND OF THE INVENTION

1. Field of the Invention

The present invention relates to means for indexing audio streams without any restriction on input media, and more particularly, to a method and system for classifying and indexing the audio streams to subsequently retrieve, summarize, skim and generally search the desired audio events.

2. Description of the Related Art

Speech is distinguished from music for input data segments that have been segmented by a segmentation unit on the base of homogeneity of their properties. It is expected, that all specific sound events, such as siren, applauses, explosions, shots, etc. are selected by some specific demons, as a rule, previously, if this selection is required.

Most known approaches to distinguishing speech from music are based on speech detection, while the presence of music is defined as exception, namely, if there is no feature, being essential for human speech, the sound stream is interpreted as music. Due to huge variety of music types, this way is in principle acceptable for processing of pragmatically expedient sound streams, such as radio/TV broadcast or sound tracks of movies. However, the robust music/speech distinguishing is so important in correctly operating consequent systems of speech recognition, speaker identification and music attribution, that errors originated from these approaches disturb normal functioning of these systems.

Among approaches to speech detection there are:

Determination of pitch presence in audio signal. This method is based on the specific properties of the human vocal tract. Human vocal sound may be presented as the sequence of similar audio segments that follow one another with the typical frequencies from 80 to 120 Hz.

Calculation of percentage of "low-energy" frames. This parameter is higher for speech than for music.

Calculation of spectral "flux" as the vector of modules of differences between frame-to-frame amplitudes. This value is higher for music than for speech.

Investigation of 4 Hz peaks for perceptual channels.

All these and other approaches do not give a reliable criterion to distinguish speech from music, have a form of probabilistic recommendations that are available in certain circumstances and are not universal.

The main advantage of the invented method is high reliability to distinguish speech from music.

SUMMARY OF THE INVENTION

Accordingly, the present invention is directed to a method and system for distinguishing speech from music in a digital audio signal in real time that substantially obviates one or more problems due to limitations and disadvantages of the related art.

An object of the present invention is to provide a method and system for distinguishing speech from music in a digital audio signal in real time, which can be used for a wide variety of applications.

Another object of the present invention is to provide a method and system for distinguishing speech from music in a digital audio signal in real time, which can be industrialscaled manufactured, based on the development of one relatively simple integrated circuit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for distinguishing speech from music in a digital audio signal in real time for the sound segments that have been segmented from an input signal of the digital sound processing systems by means of a segmentation unit on the base of homogeneity of their properties, comprises the steps of: (a) framing an input signal into sequence of overlapped frames by a windowing function; (b) calculating frame spectrum for every frame by FFT transform; (c) calculating segment harmony measure on base of frame spectrum sequence; (d) calculating segment noise measure on base of the frame spectrum sequence; (e) calculating segment tail measure on base of the frame spectrum sequence; (f) calculating segment drag out measure on base of the frame spectrum sequence; (g) calculating segment rhythm measure on base of the frame spectrum sequence; and (h) making the distinguishing decision based on characteristics calculated.

The step (c) comprises the steps of: (c-1) calculating a pitch frequency for every frame; (c-2) estimating residual error of harmonic approximation of the frame spectrum by one-pitch harmonic model; (c-3) concluding whether current frame is harmonic enough or not by comparing the estimating residual error with a predefined threshold; and (c-4) calculating segment harmony measure as the ratio of number of harmonic frames in analyzed segment to total number of frames.

The step (d) comprises the steps of: (d-1) calculating autocorrelation function (ACF) of the frame spectrums for every frame; (d-2) calculating mean value of ACF; (d-3) calculating range of values of the ACF as difference between its maximal and minimal values; (d-4) calculating ACF ratio of the mean value of the ACF to the range of values of the ACF; (d-5) concluding whether current frame is noised enough or not by comparing the ACF ratio with the predefined threshold; and (d-6) calculating segment noise measure as a ratio of number of noised frames in, the analyzed segment to the total number of frames.

The step (d) comprises the steps of: (d-1) calculating autocorrelation function (ACF) of frame spectrums for every frame; (d-2) calculating mean value of the ACF; (d-3) calculating range of values of the ACF as difference between its maximal and minimal values; (d-4) calculating ACF ratio of the mean value of the ACF to the range of values of the ACF; (d-5) concluding whether current frame is noised enough or not by comparing the ACF ratio with a predefined threshold; and (d-6) calculating segment noise measure as the ratio of the number of noised frames in analyzed segment to total number of frames.

The method according claim 1, wherein the step (f) comprises the steps of: (f-1) building horizontal local extremum map on base of spectrogram by means of sequence of elementary comparisons of neighboring magnitudes for all frame spectrums; (f-2) building lengthy quasi lines matrix, containing only quasi-horizontal lines of length not less than a predefined threshold, on base of the horizontal local extremum map, (f-3) building array containing column's sum of absolute values computed for elements of the lengthy quasi lines matrix; (f-4) concluding whether current frame is dragging out enough or not by comparing corresponding component of the array with the predefined threshold; and (f-5) calculating segment drag out measure as ratio of number of all dragging out frames in the current segment to total number of frames.

The step (f-4) is performed as comparing a corresponding component of the array with the mean value of dragging out level obtained for a standard white noise signal.

The step (g) comprises steps of: (g-1) dividing current segment into set of overlapped intervals of fixed length; (g-2) determining of interval rhythm measures for interval of the fixed length; and (g-3) calculating segment rhythm measure as an averaged value of the interval rhythm measures for all intervals of the fixed length containing in the current segment.

The method of claim 7, wherein the step (g-2) comprises the steps of: (g-2-i) dividing the frame spectrum of every frame, belonging to an interval, into predefined number of bands, and calculating the bands, energy for every band of the frame spectrum; (g-2-ii) building functions of spectral bands' energy as functions of frame number for every band, and calculating autocorrelation functions (ACFs) of all the functions of the spectral bands' energy; (g-2-iii) smoothing all the ACFs by means of short ripple filter; (g-2-iv) searching all peaks on every smoothed ACFs and evaluating altitude of peaks by means of an evaluating function depending on a maximum point of peak, an interval of ACF increase and an interval of ACF decrease; (g-2-v) truncating all, the peaks having the altitude less than the predefined threshold; (g-2-vi) grouping peaks in different bands into-groups of peaks accordingly their lag values equality, and evaluating the altitudes of the groups of peaks by means of an evaluating function depending on altitudes of all peaks, belonging to the group of peaks; (g-2-vii) truncating all the groups of peaks not having the correspondent groups of peaks with double lag value, and calculating dual rhythm measure for every couple of the groups of peaks as the mean value of the altitude of a group of peaks and the altitude of the correspondent group of peaks with double lag; and (g-2-viii) determining interval rhythm measures as a maximal value among all the dual rhythm measures for every couple of the groups of peaks calculated for this interval.

The step (h) is performed as the sequential check of the ordered list of the certain conditions' combinations expressed in terms of logical forms comprising comparisons of segment harmony measure, segment noise measure, segment tail measure, segment drag out measure, segment rhythm measure with predefined set of thresholds until one of conditions' combinations become true and the required conclusion is made.

In another aspect of the present invention, a system for distinguishing speech from music in a digital audio signal in real time for sound segments that have been segmented from an input digital signal by means of a segmentation unit on base of homogeneity of their properties, comprises: a processor for dividing an input digital speech signal into a plurality of frames; an orthogonal transforming unit for transforming every frame to provide spectral data for the plurality of frames; a harmony demon unit for calculating segment harmony measure on base of spectral data; a noise demon unit for calculating segment noise measure on base of the spectral data; a tail demon unit for calculating segment tail measure on base of the spectral data;a drag out demon unit for calculating segment drag out measure on base of the spectral data; a rhythm demon unit for calculating segment rhythm measure on base of the spectral data; a processor for making distinguishing decision based on characteristics calculated.

The harmony demon unit further comprises: a first calculator for calculating a pitch frequency for every frame; an estimator for estimating a residual error of harmonic approximation of frame spectrum by one-pitch harmonic model; a comparator for comparing the estimated residual error with the predefined threshold; and a second calculator for calculating the segment harmony measure as the ratio of number of harmonic frames in analyzed segment to total number of frames.

The system noise demon unit further comprises: a first calculator for calculating an autocorrelation function (ACF) of frame spectrums for every frame; a second calculator for calculating mean value of the ACF; a third calculator for calculating range of values of the ACF as difference between its maximal and minimal values; a fourth calculator of ACF ratio of the mean value of the ACF to range of values of the ACF; a comparator for comparing an ACF ratio with a predefined threshold; and a fifth calculator for calculating segment noise measure as ratio of number of noised frames in analyzed segment to total number of frames.

The tail demon unit further comprises: a first calculator for calculating a modified flux parameter as ratio of Euclid norm of the difference between spectrums of two adjacent frames to Euclid norm of their sum; a processor for building histogram of values of the modified flux parameter calculated for every couple of two adjacent frames in current segment; and a second calculator for calculating segment tail measure as sum of values along right tail of the histogram from a predefined bin number to the total number of bins in the histogram.

The drag out demon unit further comprises: a first processor for building horizontal local extremum map on base of spectrogram by means of sequence of elementary comparisons of neighboring magnitudes for all frame spectrums; a second processor for building lengthy quasi lines matrix, containing only quasi-horizontal lines of length not less than a predefined threshold, on base of the horizontal local extremum map; a third processor for building array containing column's sum of absolute values computed for elements of the lengthy quasi lines matrix; a comparator for comparing the column's sum corresponding to every frame with the predefined threshold; and a fourth calculator for calculating segment drag out measure as ratio of number of all dragging out frames in current segment to total number of frames.

The rhythm demon unit further comprises: a first processor for dividing current segment into set of overlapped intervals of a fixed length; a second processor for determining of interval rhythm measures for interval of the fixed length; and a calculator for calculating segment rhythm measure as an averaged value of the interval rhythm measures for all the intervals of the fixed length containing in the current segment.

The second processor comprises: a first processor unit for dividing the frame spectrum of every frame, belonging to the said interval, into predefined number of bands, and calculating the bands' energy for every said band of the frame spectrum; a second processor unit for building the functions of the spectral bands, energy as functions of frame number for every said band, and calculating the autocorrelation functions (ACFs) of all the functions of the spectral bands' energy; a ripple filter unit for smoothing all the ACFs; a third processor unit for searching all peaks on every smoothed ACFs and evaluating the altitude of the peaks by means of an evaluating function depending on a maximum point of the peak, an interval of ACF increase and an interval of ACF decrease; a first selector unit for truncating all the peaks having the altitude less than the predefined threshold; a fourth processor unit for grouping peaks in different bands into the groups of peaks accordingly their lag values equality, and evaluating the altitudes of the groups of peaks by means of an evaluating function depending on altitudes of all peaks, belonging to the group of peaks; a second selector unit for truncating all the groups of peaks not having the correspondent groups of peaks with double lag value, and calculating dual rhythm measure for every couple of the groups of peaks as mean value of the altitude of a group of peaks and the altitude of the correspondent group of peaks with double lag; and a fifth processor unit for determining of the interval rhythm measures as a maximal value among all dual rhythm measures for every couple of the groups of peaks calculated for this interval.

The processor making distinguishing decision is implemented as decision table containing ordered list of certain conditions' combinations expressed in terms of logical forms comprising comparisons of segment harmony measure, the segment noise measure, the segment tail measure, the segment drag out measure, the segment rhythm measure with predefined set of thresholds until one of the conditions' combinations become true and required conclusion is made.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 6 is a decision table illustrating the method of distinguishing speech from music.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
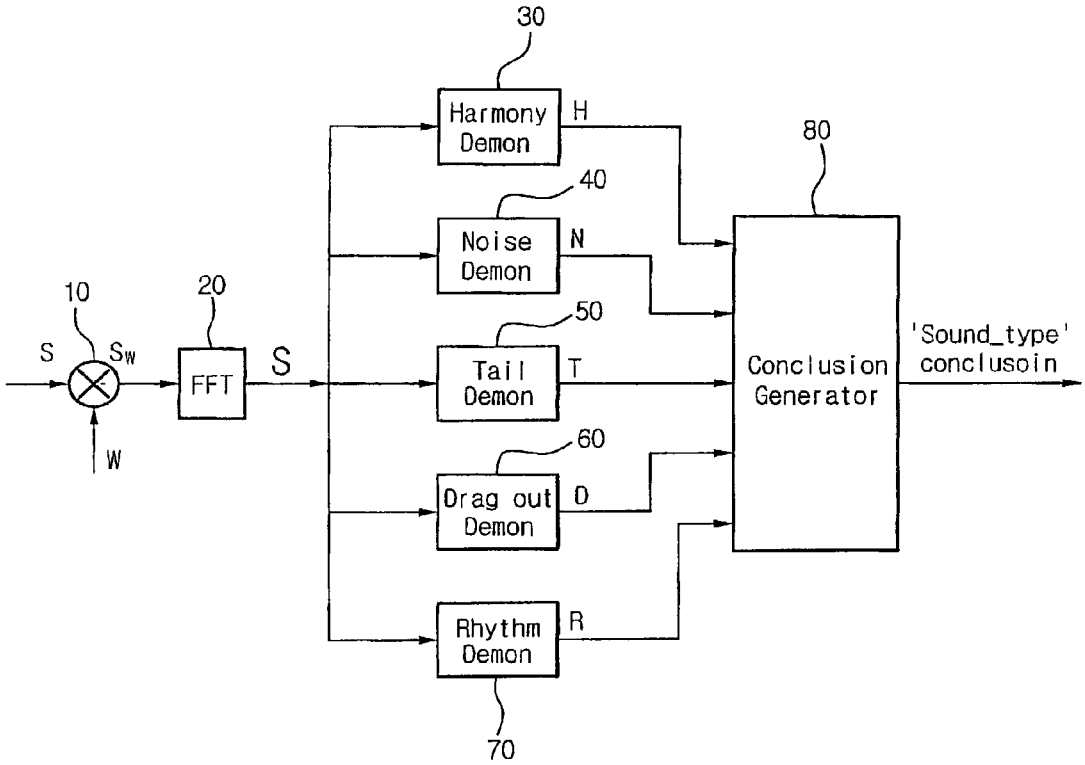
FIG. 1 is a block diagram of the proposed procedure.

In accordance to the invented method, described below operations are performed with the digital audio signal. A general scheme of the distinguisher is shown in FIG. 1 including a Hamming Windowing unit 10, a Fast Fourier Transform (FFT) unit 20, a Harmony Demon unit 30, a Noise Demon unit 40, a Tail Demon unit 50, a Drag out Demon unit 60, a Rhythm Demon unit 70, and Conclusion Generator unit 80.

For the parameter determination, the input digital signal is first divided into overlapping frames. The sampling rate can be 8 to 44 KHz In preferred embodiment the input signal is divided into frames of 32 ms with frame advance equal to 16 ms For the sampling rate being equal to 16 kHz, it corresponds to FrameLength=512 and FrameAdvance=256 samples. At the Windowing unit 10, signal is multiplied by a window function W for spectrum calculation performed by the FFT unit 20. In preferred embodiment the Hamming window function is used, and for all described below operations FFLength=FrameLengh=512. The spectrum calculated by the FFT unit 20 comes to the particular demon units to calculate the numerical characteristics that are specific for the problem. Each one characterizes the current segment in a special sense.

The Harmony Demon unit 30 calculates the value of a numerical characteristic called the segment harmony measure that is defined as follows:

$$H=n_h/n,$$

where $n_h$ is a number of the frames having the pitch frequency that approximates whole frame spectrum by means of one-pitch harmonic model with predefined precision, and n is the total number of frames in the analyzed segment.

So, the Harmony Demon unit operates with pitch frequency calculated for every frame, estimates residual error of harmonic approximation of the frame spectrum by the one-pitch harmonic model, concludes whether the current frame is harmonic enough or not, and calculates the ratio of the number of harmonic frames in the analyzed segment to total number of frames.

The above-described value the H variable is just the segment harmony measure calculated by the Harmony Demon unit 30. In the preferred embodiment the following threshold values for the harmony measure H are set:

$H_1$=0.70 is the high level of the harmony measure and $H_0$=0.50 is its low level.

The segment harmony measure calculated by the Harmony Demon unit 30 is passed to the first input of the Conclusion Generator unit 80.

Now, the noise characteristics of the analyzed segment will be described. The noise analysis of sound segment has the self-dependent importance, and aside, certain noise components are parts of music and speech, as well. The diversity of acoustic noise makes difficulties for effective noise identification by means of one universal criterion. The following criteria are used for the noise identification.

The first criterion is based on absence of a harmony property of frames. From above, under harmony we mean the property of signal to have a harmonic structure, a frame is considered as harmonic if the relative error of approximation is less than a predetermined threshold. The disadvantage of this criterion is that it shows the high value of the relative approximation error for musical fragments containing inharmonic chords. That is so due to the fact that the considered signal contains two or more harmonic structures.

The second criterion, so called ACF criterion, is based on calculation autocorrelation functions of the frame spectrums. As the criterion, one can use the relative number of frames for which the ratio of mean ACF value to the value of ACF variation range is higher than a threshold. For broadband noise, the high value of ACF mean and the narrow range of ACF variations are typical. Therefore, the value of ratio is high. For voiced signal, the range of variations is wider and the ratio is lower.

Another feature of noise signals comparing with musical one is the relatively high stationarity. It allows to use as criterion the property of band energy stationarity along the time. The stationartiy property of noise signal is exact opposite to the rhythm presence. However, it allows to analyze the stationarity in the same way as the rhythm property. Particularly, the ACFs of bands' energy are analyzed.

In the proposed music/speech discrimination method all three above-mentioned criteria are used: the harmony criterion, the ACF criterion and the stationarity criterion, but the first and the third criteria are used implicitly, as absent of harmony measure и rhythm measure correspondingly, while the second one, namely ACF criterion explicitly lies in the base of the Noise Demon unit 40.

The calculation of the segment noise measure by the Noise Demon unit 40 is described below in details.

Let $s_i$ be the FFT spectrum of the i-th frame, i=1, n, where n is the total number of frames in the analyzed segment and let $S_i^+$ be a denotation of the part of $S_i$ lying higher than a frequency value Flow.

For every $S_i^+$, considered as a function of frequency, the autocorrelation function, $ACF_i[k]$ is built.

1. The value of the frame noise measure $v_i$ is calculated as a ratio $$v_i = \frac{a_i}{r_i},$$

where $a_i$ is an averaged value of the $ACF_i[k]$ for all shift values $k \in [\alpha,\beta]$:

$$a_i = \frac{1}{\beta-\alpha}\sum_{k=\alpha}^{\beta} ACF_i[k],$$

and $r_i$ is a range value of the $ACF_i[k]$ for all shift values $k \in [\alpha, \beta]$, $$r_i = \max_{k\in[\alpha,\beta]}\{ACF_i[k]\} - \min_{k\in[\alpha,\beta]}\{ACF_i[k]\}.$$

Here, α and β are correspondingly the start number and finish number for the processing $ACF_i[k]$ mid-band.

2. For the whole segment, a ratio is calculated as $$N = \frac{n_v}{n},$$

where n is the total number of frames in the analyzed segment, and $n_v$ is a number of the frames having the frame noise measure $v_i$ greater than a predefined threshold value $T_v$:

$$n_v = \sum_{i=1}^{n}\{1 \mid v_i > T_v\}.$$

In the preferred embodiment Flow=350 Hz, α=5, β=40, and the value of the threshold $T_v$ is equal to 3.3.

The above-described value of the ratio $N=n_v/_n$ is just the segment noise measure calculated by the Noise Demon unit 40 for taking the part in conclusion making, and it is passed to the second input of the Conclusion Generator unit 80. The minimal and maximal values of the segment noise measure are 0.0 and 1.0, correspondingly. We set the boundaries of the certain areas of the segment noise measure: $N_0$ is a lower boundary for a high noise area, and $N_{low}$ is an upper boundary for a low noise area. In the preferred embodiment the following threshold values for these areas are used: $N_0$=0.50 and $N_{low}$=0.40.

The Tail Demon unit 50 calculates the value of a numerical characteristic called the segment tail measure that is defined as follows.

Let $f_i$, $f_{i+1}$ is the adjacent overlapping frames with the length equal to FrameLength and the advance equal to FrameAdvance. Let $S_i$, $S_{i+1}$, be the FFT spectrums of the frames.

Then the modified flux parameter is defined as:

$$Mflux_i = \sqrt{\frac{dif_i}{sum_i}},$$

where $$dif_i = \sum_{k=L}^{H}(S_i[k] - S_{i+1}[k])^2, \quad sum_i = \sum_{k=L}^{H}(S_i[k] + S_{i+1}[k])^2.$$

Here, L and H are correspondingly the start number and the finish number for the spectrum mid-band processed.

Figure 2A:
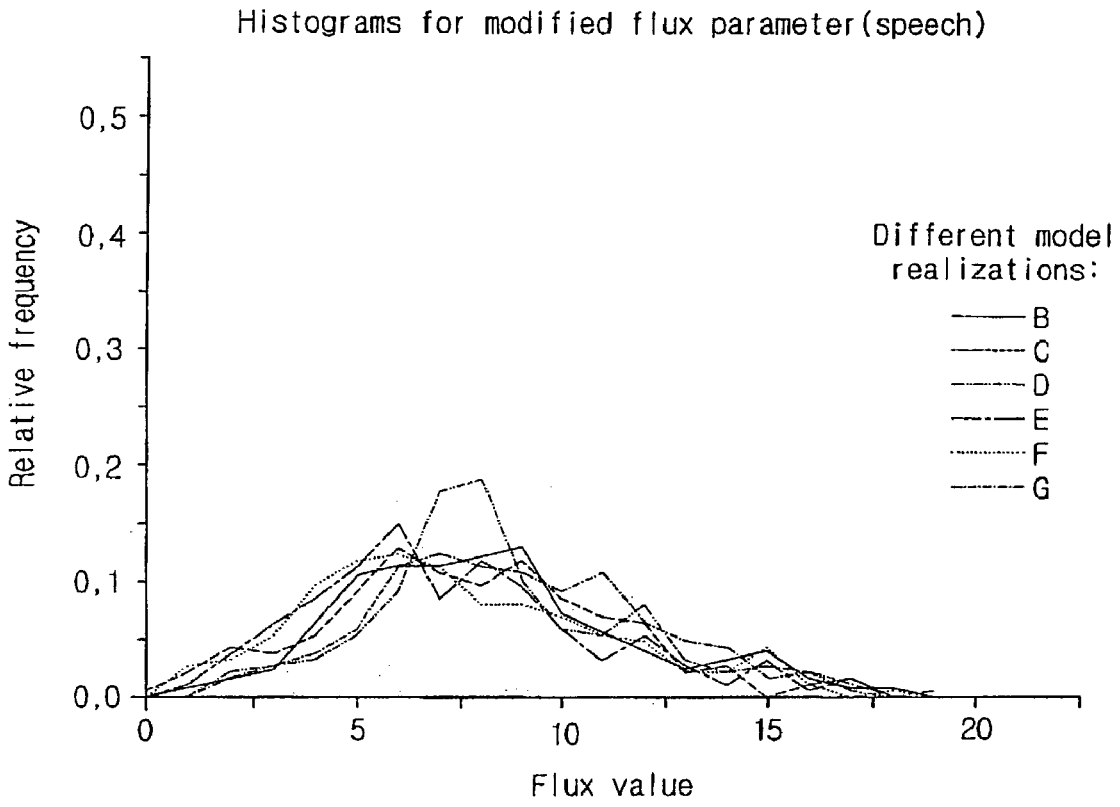
FIGS. 2*a* through 2*c* are histograms of modified flux parameter for typical speech, music and noise segments.
Figure 2B:
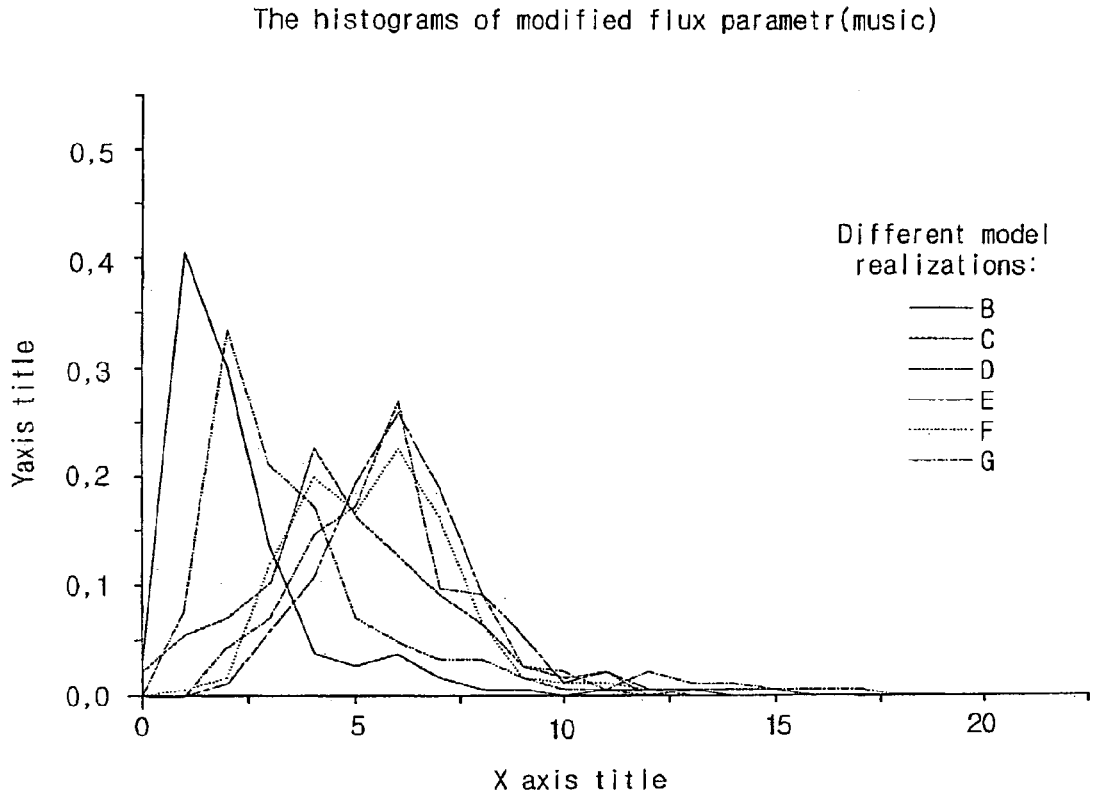
Figure 2C:
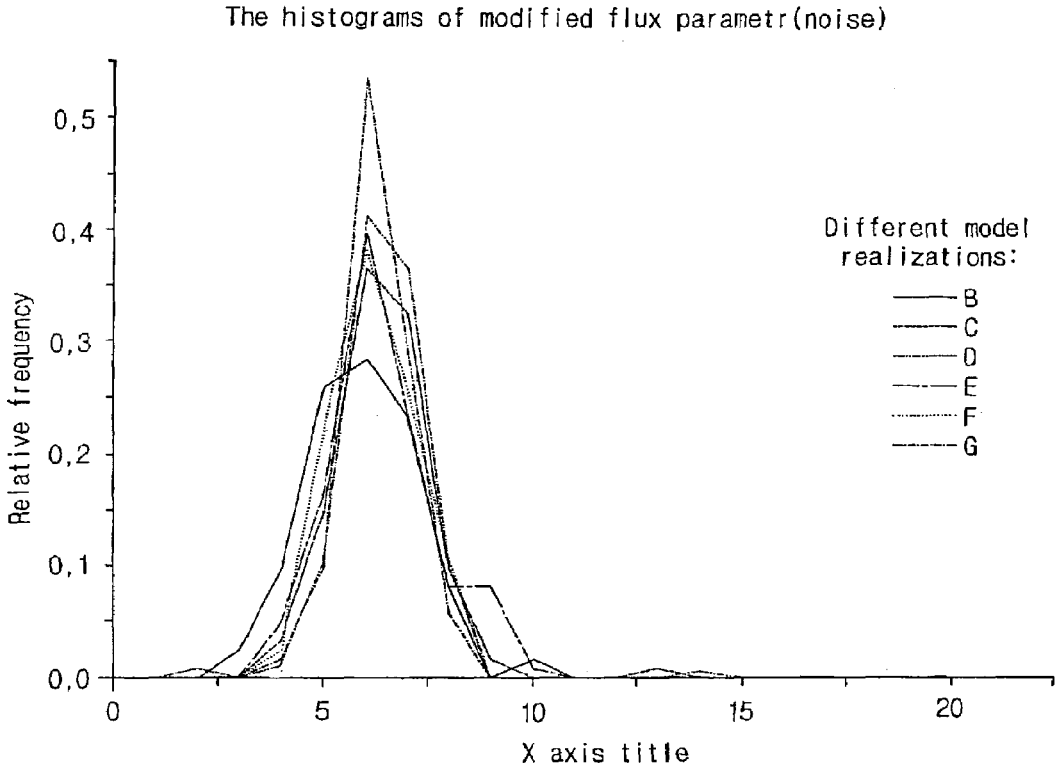

The histograms of "modified flux" parameter for speech, music and noise segments of audio signal are given in FIGS. 2*a* to 2*c* for the following parameter values used for Mflux calculation:

$$L=FFT\text{Length}/32,\ H=FFT\text{Lengh}/2.$$

It follows from the comparative analysis of these diagrams that the histogram of speech signal significantly differs from the music's and the noise's ones. It is evident that the most visible difference appears at the right tail of histogram:

$$TailR(M) = \sum_{i=M}^{i_max} H_i,$$

where $H_i$ is the value of the histogram for i-th bin; M is a bin number corresponding to the beginning of the right tail of histogram; i_max is the total number of bins in the histogram.

Figure 3:
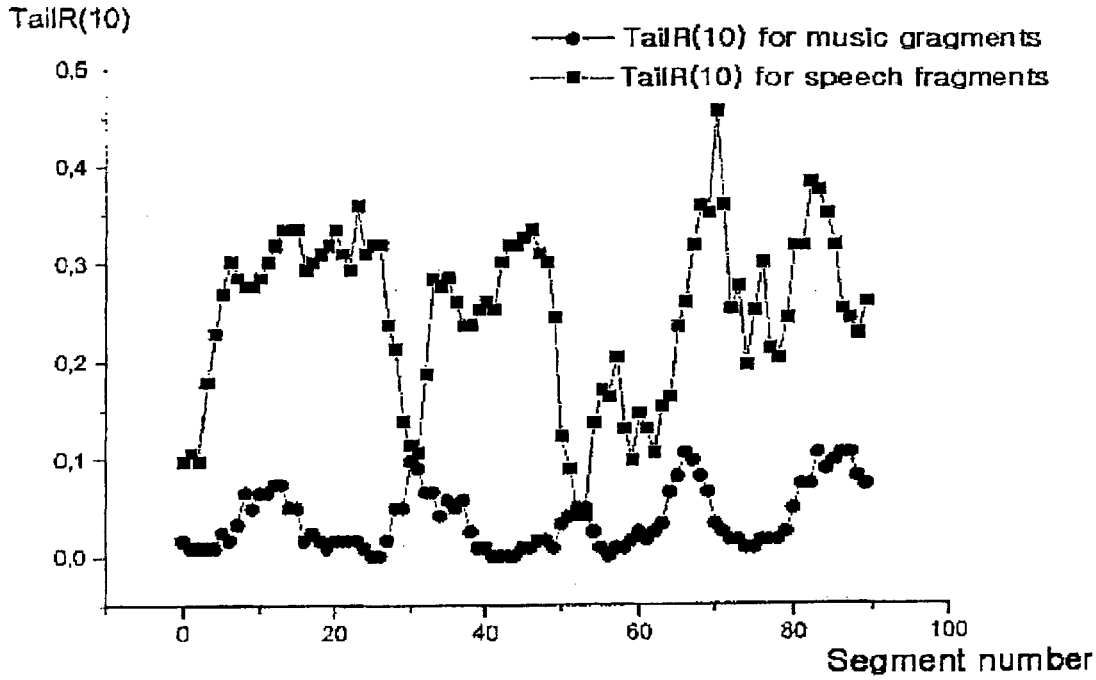
FIG. 3 is a diagram of TailR(10) obtained for music and speech fragments.

From numerous experiments the following parameter values were set for the practical TailR(M) calculation: M=10, t_max=20. The diagrams of TailR(10) value for music fragment and speech fragment is shown in FIG. 3. In this figure, every point corresponds to certain sound segment having length 2s. It is clearly seen that a separation level to distinguish speech from music can be set nearly equal to 0.09. The important feature of the tail parameter is its stability. For example, the addition of noise to a speech signal decreases the value of the tail parameter, but the diminution is rather slow. The above-described value of the tail parameter is just the segment tail measure T=TailR(10) calculated by the Tail Demon unit 50 and passed to third input of the Conclusion Generator unit 80.

The minimal and maximal values of the tail parameter are 0.0 and 1.0, correspondingly. The tail value for most kind of music signals does not reach practically the value equal to 0.1. Therefore the reasonable way to use the tail parameter is setting of an uncertain area. We set the boundaries of the certain ranges: Tmusic is the high value of the tail parameter for music and Tspeech is the low value of the tail parameter for speech. After additional experiments two stronger boundaries were added: Tspeech_def is the minimal value for undoubtedly speech and Tmusic_def is the maximal value for undoubtedly music. All these tail parameter boundaries take part in the certain combinations of conditions in Conclusion Generator unit 80.

The above-described music/speech distinguishing criterion based on the tail parameter has shown the satisfactory discrimination quality. However, its two deficiencies are:

A wide vagueness zone;

A presence of errors in zones where the correct decisions must be taken. Sometimes exact singing may be classified as a speech and noisy speech may be classified as music.

The Drag out Demon unit 60 calculates the value of another numerical characteristic called the segment drag out measure that is defined as follows.

For further discovery music features, it was proposed to build a Horizontal local extremum map (HLEM). The map is built on the base of the spectrogram of the whole buffered sound stream before the classification of the certain segments. This operation for building this map is called 'Spectra Drawing' and leads to a sequence of elementary comparisons of the neighboring magnitudes for all frame spectrums.

Let S[f,t], f=0, 1, . . . , $N_f$−1, t=0, 1, . . . , $N_t$−1 denotes a matrix of the spectral coefficients for all frames in the current buffer. Hire $N_f$ is a number of the spectral coefficients that is equal to FFTLength/2−1, and $N_t$ is a number of the frames to be analyzed. Here, an index f relates to the frequency axis and means a corresponding spectral coefficient number, while an index t relates to the discrete time axis and means a corresponding frame number.

Then a matrix of HLEM, H=‖h[f, t]‖, f=1, 2 . . . , $N_f$−2, t=1, 2, . . . , $N_t$−2 is defined as follows:

$$h[f,t]=\begin{cases}1 \text{ if } (s[f,t]>s[f-1,t]\ \&(s[f,t]>s[f+1,t]),\\ -1 \text{ if } (s[f,t]<s[f-1,t]\ \&(s[f,t]<s[f+1,t]),\\ 0 \text{ other case.}\end{cases}$$

The matrix H is very simple calculated but it has a very big information volume. One can say, it retain the main properties of the spectrogram but it is a very simplified its model. The spectrogram is a complex surface in the 3D area, while the HLEM is a 2D ternary image. The longitudinal peaks relative to the time axis of the spectrogram are represented by the horizontal lines on the HLEM. One can say, that HLEM is some plain <<imprints>> of the outstanding parts of the spectrogram's surface, and similar to the finger-prints used in dactylography, it can serve to characterize the object, which it presented. At that, the following advantages are obvious:

extremely simple calculating cost, as only comparison operations are used, negligible analyzing, as all calculations lead to the logical operations and counters, involuntary equalization of the peaks' sizes in the different spectral diapasons. (During an analysis of the spectrogram, it is need to apply certain sophisticated non-linear transformations in order to don't loss relatively small peaks in HF areas).

The HLEM characterizes the melodic properties of the sound stream. The much melodic and drawling sounds are present in the stream to be analyzed, the more number of the horizontal lines are visible in HLEM and the more prolonged these lines are. At that, the definition of <<horizontal line>> can be treated in the strict sense of the word as a sequence of unities, placed in adjacent elements of a row of the matrix H. Aside from, one can introduce a conception of a <<n-quasi-horizontal line>>. The <<n-quasi-horizontal line>> is built in the same way as a horizontal line but it can permit one-element deviations up or down if the length of every deviation is not more than n and can ignore gaps of (n−1) length. For comparison, an example of a horizontal line and two examples of n-quasi-horizontal line of length 12 for n=1 and for n=2 are given below.

An example of a horizontal line of length 20:

| | | | | | | | | | | | | | | | | | | | | | | | | |
|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 1 | 1 | 1 | 1 | 1 | 1 | 1 | 1 | 1 | 1 | 1 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

An example of 1-quasi-horizontal line of length 20:

| | | | | | | | | | | | | | | | | | | | | | | | | |
|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 1 | 0 | 0 | 0 | 0 | 0 |
| 0 | 0 | 0 | 1 | 1 | 0 | 1 | 1 | 1 | 1 | 1 | 1 | 1 | 1 | 1 | 1 | 1 | 1 | 1 | 0 | 1 | 1 | 1 | 0 | 0 |
| 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 | 0 | 0 |

An example of 2-quasi-horizontal line of length 20:

| | | | | | | | | | | | | | | | | | | | | | | | | |
|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 1 | 1 | 0 | 0 | 0 | 0 |
| 0 | 0 | 0 | 1 | 1 | 0 | 0 | 1 | 1 | 1 | 1 | 1 | 0 | 1 | 1 | 1 | 1 | 1 | 1 | 0 | 0 | 1 | 1 | 0 | 0 |
| 0 | 0 | 0 | 0 | 0 | 1 | 1 | 0 | 0 | 0 | 0 | 0 | 0 | 0 | 0 | 0 | 0 | 0 | 0 | 0 | 0 | 0 | 0 | 0 | 0 |

In this way, on the base of the matrix H, one can build a matrix $\overline{H}_L^n$, containing the only n-quasi-horizontal lines of length not less than L.

Figure 4A:
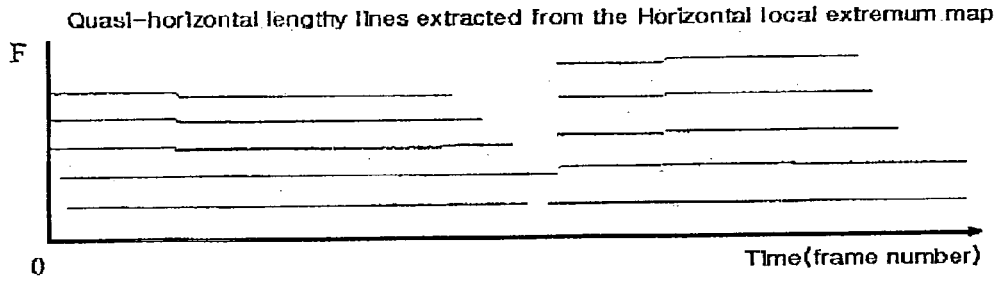
FIGS. 4*a* through 4*c* illustrate time diagrams for operations of the Drag out Demon unit.

These lengthy lines extracted from HLEM are shown in FIG. 4*a*. A flat instrumental music as well as a flat song produces a large number of lengthy lines. As distinct from the flat music and songs, a percussion band's temperamental music and a virtuoso-varying music is characterized by shorter horizontal lines. Human speech also produces the horizontal lines on HLEM when the vowel sounds are sounding but these horizontal lines are grouped into vertical strips and they alternate with areas consisting in short lines and isolated points. These isolated points are result of noised sounds pronunciation.

Figure 4B:
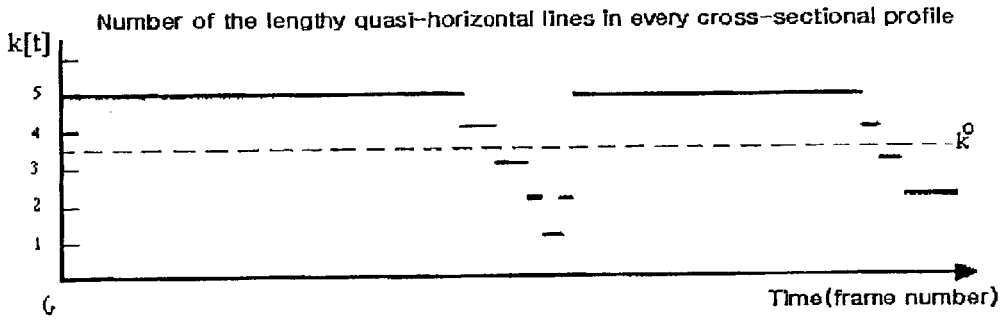
Figure 4C:
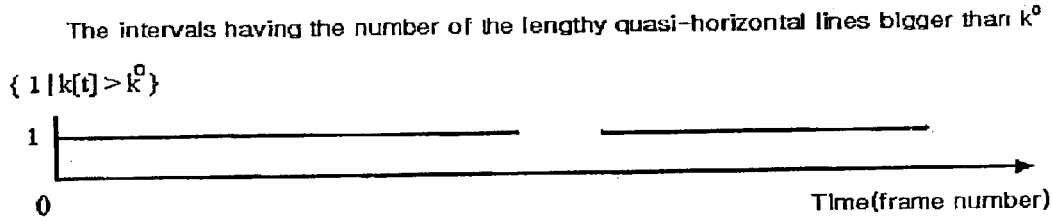

Let's consider an arbitrary t-th column of the matrix $\overline{H}_L^n$; the column contains elements $\overline{h}[f,t]$. The quantity of nonzero elements in this column $$k[t] = \sum_{f=1}^{N_f-2} |\overline{h}[f,t]|$$

has a meaning of a number of the lengthy horizontal lines in the corresponding cross-sectional profile of the HLEM. These number values calculated as the lengthy horizontal lines in all cross-sectional profiles are shown in FIG. 4*b*. Then, let's count the number $$d = \sum_{t=T_e}^{T_e} \left\{ 1 \mid k[t] > \overset{0}{k} \right\} \text{ of}$$

such columns for what the quantity k[t] exceeds a predefined value $\overset{0}{k}$. The quantity d has a meaning of the total length of such time intervals during that the number of the lengthy horizontal lines is big enough (bigger than $\overset{0}{k}$). These intervals are shown in FIG. 4*c*. In the capacity of the threshold value $\overset{0}{k}$, one can assign a mean value of the quantities k[t] obtained for the standard white noise signal.

Since a large amount of the lengthy horizontal lines distributed evenly through the segment size is typical for music, the quantity d has rather large value. On the other hand, since the grouping of the horizontal lines into vertical strips alternating with some gaps is typical for speech, the quantity d cannot have too large value.

The ratio of the quantity d to size of the time interval [$T_s$, $T_e$] where this evaluation has been performed $$D = \frac{d}{T_e - T_s}$$

is called a "resounding ratio" and it can serve as the required drag out measure of the segment. When the ratio is calculated for the current segment, $T_s$ corresponds to the first frame of the segment, and $T_e - T_s = n$, where n is the number frames in the segment. So, the Drag out Demon unit 60 calculates the value of drag out measure of the segment $$D = \frac{d}{n}$$

and passes it to the fourth input of the Conclusion Generator unit 80.

After a series of experiments, it was stated that the best distinguishing speech from music results were obtained by criteria set:

$$D \geqq D^b,$$

$$D \leqq D^n, \text{ and}$$

$$D^n < D < D^b,$$

where $D^b$ and $D^n$ are the upper and lower discriminating thresholds which have the following meaning.

At first, if a current sound segment is characterized by a value of the drag out measure greater than $D^b$, this segment cannot be a speech. At second, if a current sound segment is characterized by a value of the drag out measure less than $D^n$, this segment cannot be a melodic music and only presence of rhythm allow us classify it as a musical composition or its part. At last, if $D^n < D < D^b$, one can only declare about the current segment that it is either musical speech or talking music.

All these boundaries of the drag out measure together with those for the tail parameter take part in the certain combinations of conditions in the Conclusion Generator unit 80.

The Rhythm Demon unit 70 calculates the value of a numerical characteristic called the segment rhythm measure that is defined as follows.

One of features, which can be used to distinguish music fragments from speech and noise fragments, is presence of a rhythmical pattern. Certainly, not every music fragment contains definite rhythm. On the other hand, in some speech fragments there can be certain rhythmical reiteration, though, not so strongly pronounced as in music. Nevertheless, discovery of a music rhythm makes possible to identify some music fragments with a high level of reliability.

The music rhythm is become apparent in this case by means of repeating noise streaks, which results from impact tools. Identification of music rhythm was proposed in [5] using "pulse metric" criterion. A division of the signal spectrum into 6 bands and the calculation of bands' energy are used for the computation of the criterion value. The curves of spectral bands' energy as function of time (frame numbers) are built. Then the normalized autocorrelation functions (ACFs) are calculated for all bands. The coincidence of peaks of ACFs is used as a criterion for identification of rhythmic music. In present patent application a modified method is used for rhythm estimation having the following features. First, before peaks search, the ACFs functions are previously smoothed by the short (3–5 taps) filter. At this time, disappearance of small casual local maximums in ACFs not only causes reduction of processing costs, but also decreases relative significance of regular peaks. As a result of this, the distinguishing properties of the criterion have improved. The second distinctive feature of the proposed algorithm is usage of a dual rhythm measure for every pretender to value of the rhythm lag. It is clear that if a value of certain time lag is equal to the true value of the time rhythm parameter, the doubled value of this time lag corresponds to some other group of peaks. In other case, if the certain time lag is casual, the doubled value of this time lag doesn't correspond to any group of peaks. In this way we can discard all casual time lags and choose the best value of time rhythm parameter from the pretenders. Just the usage the dual rhythm measure allows us to throw off safely all accidental rhythmical coincidences encountered in human speech, and to apply successfully the criterion to distinguish speech from music.

Therefore, the main steps of the method for rhythmic music identification are as follows:

1. The search of ACF peaks. Every peak consists of a maximum point, an interval of ACF increase $[t_1, t_m]$ and an interval of ACF decrease $[t_m, t_r]$.

2. The truncation of small peaks. Peak is qualified as small peak if the following equation satisfied:

$$ACF(t_m)-0.5\cdot(ACF(t_l)+ACF(t_r))>T_r,\ T_r=0.05.$$

Figure 5:
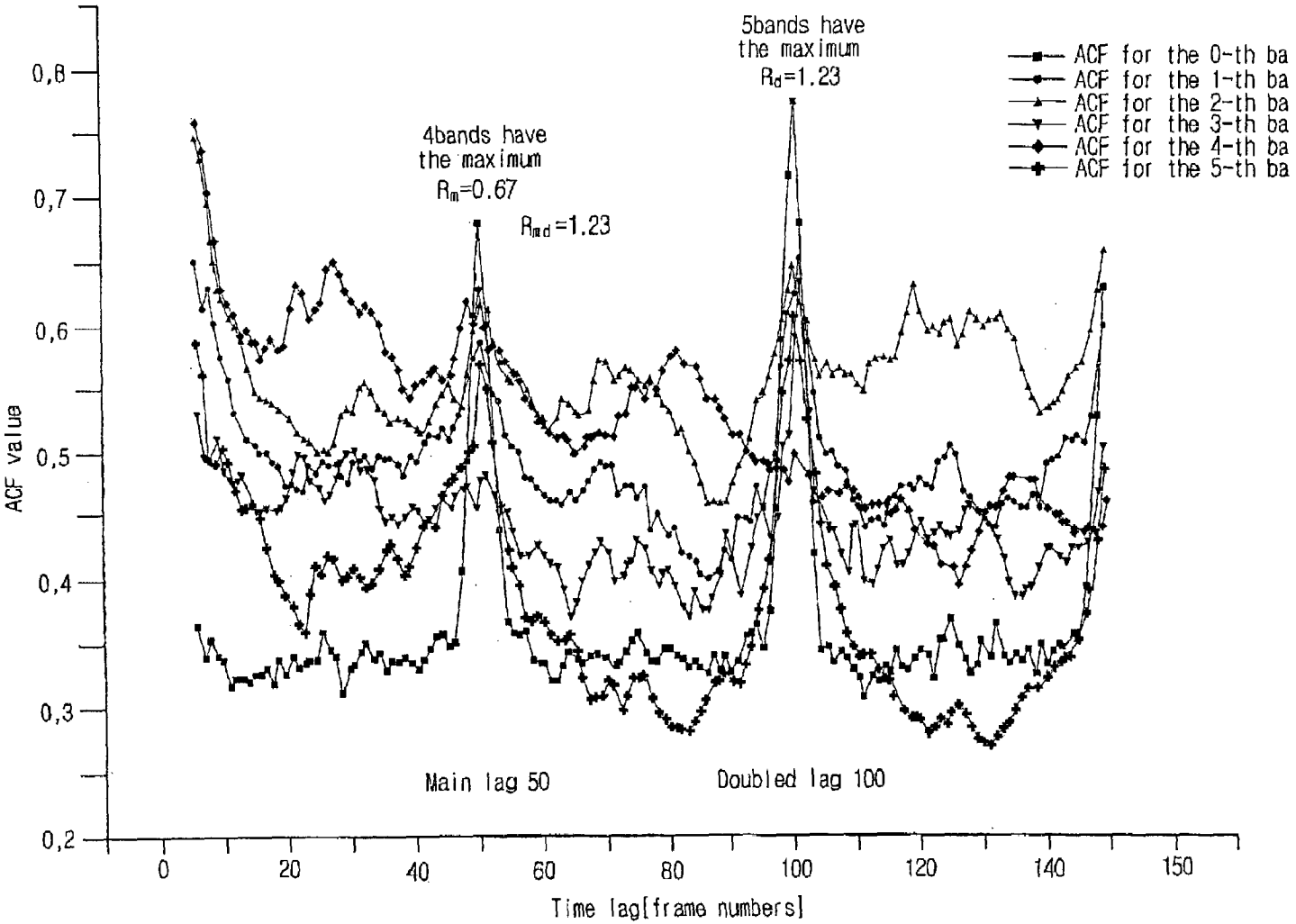
FIG. 5 illustrates a set of the ACFs for a musical segment having strong rhythm.

3. The grouping peaks in several bands, corresponding to nearly the same lag values. FIG. 5 shows ACFs for a musical segment with strong rhythm. One can see two groups of peak for the lag value equal to 50 and for the lag value equal to 100.

4. The calculation of a numerical characteristic for every group of peaks. The summarized height of peaks is used as the numerical characteristic of peaks group. Let's assume that a group of k peaks $2 \leqq k \leqq 6$ is described by the intervals of increase $[t_l^i, t_m^i]$ and intervals of decrease $[t_m^i, t_r^i]$, where i=0, . . . , k−1. Then the summarized height of peaks is calculated by the following equation:

$$R_m = 0.5\cdot\sum_{i=0}^{k-1}(2\cdot ACF(t_m^i) - ACF(t_l^i) - ACF(t_r^i))$$

5. The calculations of a dual rhythm measure for every pretender. Every group of peaks corresponds to its own time lag, which is a pretender for the time rhythm parameter to be looked for. It is clear that if a value of certain time lag is equal to the true value of the time rhythm parameter, the doubled value of this time lag corresponds to some other group of peaks. In other case, if the certain time lag is casual, the doubled value of this time lag does not correspond to any group of peaks. In this way we can discard all casual time lags and choose the best value of time rhythm parameter from the pretenders. The dual rhythm measure $R_{md}$ is calculated for every pretender as follows:

$$R_{md}=(R_m+R_d)/2,$$

where $R_m$ is the summarized height of peaks for main value of the time lag, $R_d$ is the summarized height of peaks for doubled value of the time lag.

If the doubled value of the pretender time lag does not correspond to any group of peaks, the value $R_{md}$ is assigned to be equal 0.

6. Choice the best pretender. The largest value of the dual rhythm measure calculated for every pretender points to the best choice. The dual rhythm measure and the corresponding time lag are two variables for the following taking the decision.

7. Taking the decision about presence of rhythm in the current time interval of the sound signal. If the value of the dual rhythm measure greater than a certain predetermined threshold value, the current time interval is classified as rhythmical.

The length of the time interval for applying the above-described procedure is constrained by range of rhythm time lags to be reliable recognized. For the most usable lags in range from 0.3 to 1.0 seconds, the time interval have to be not shorter than 4 s. In the preferred embodiment the standard length of the time interval for rhythm estimation was assigned equal to 216=65536 frames that corresponds to 4.096 s.

For calculating the segment rhythm measure R, the current segment is divided into set of overlapped time intervals of the fixed length. Let kR be the number of the time intervals of standard length in the current segment. If kR<1, the rhythm measure can not be determined due to the length of the current segment is less than the time intervals of standard length required for the rhythm measure determination. Then the dual rhythm measure is calculated for every fixed length segment, and the segment rhythm measure R is calculated as a mean value of the dual rhythm measures for all fixed length segments contained in the segment. Besides, if two values of time lag for every two successive fixed length segments differ from each other a little only, the sound piece is classified as having strong rhythm.

The above-described value of the segment rhythm measure R calculated by the Rhythm Demon unit 70 is passed to fifth input of the Conclusion Generator unit 80.

Now, the Conclusion Generator unit 80 will be described in detail. This block is aimed to make certain conclusion about type of the current sound segment on the base of the numerical parameters of the sound segment. These parameters are: the harmony measure H coming from the Harmony Demon unit 30, the noise measure N coming from the Noise Demon unit 40, the tail measure T coming from the Tail Demon unit 50, the drag out measure D coming from the Drag out Demon unit 60, and the rhythm measure R coming from the Rhythm Demon unit 70.

The analysis, performed on a big set of musical and voice sound clips, shows that the sound, generally named as 'music' has so many types, that a try to find a universal discriminative criterion fails every time. Considering the following musical compositions: solo of a melodious musical instrument, solo of drums, synthesized noise, arpeggio of piano or guitar, orchestra, song, recitative, rap, hard rock or "metal", disco, chorus etc., the question arises what is common among them. In the common sense, any music has melody and/or rhythm, but each of these features is not necessary. Therefore, the rhythm analysis is the important task of distinguishing speech from music, as well as the melody analysis.

Basing on the above-mentioned, the decision-making rules in the Conclusion Generator unit 80 are implemented in the following way. The main music/speech distinguishing criterion is based on the combination of the tail of histogram for the modified flux parameter. All the tail changing range is divided to 5 intervals:

Exactly musical segment T<Tmusic_def,
Probably musical segment Tmusic_def<T<Tmusic,
Undefined segment Tmusic<T<Tspeech
Probably, speech segment Tspeech<T<Tspeech_def
Exactly speech segment Tspeech_def<T.

The following threshold values were experimentally defined for the preferred embodiment:

Tmusic_def=0.015, Tmusic=0.075, Tspeech=0.09, Tspeech_def=0.2.

The decisions for two utmost intervals are accepted once and for all. In the three middle intervals, where the tail criterion decision is not exact or absent, the conclusion about segment is based on the drag out parameter D, the second numerical characteristics for distinguishing speech from music, named "resounding ratio". If the audio segment is characterized by the resounding-ratio value more than $D_{updef}$, $D \geqq D_{updef}$, the segment is definitely not a speech, but music. If the audio segment is characterized by the resounding-ratio value less than $D_{low}$, $D<D_{low}$, the segment is not a melodious music and only the presence of exact rhythm measure R may define that nevertheless this is music.

Let k_R be the number of the time intervals of standard length in the current segment that have been processed in the Rhythm Demon unit. If k_R<1, the rhythm measure is not determined due to the length of the current segment is less then the time intervals of standard length required for the rhythm measure determination.

$R_{def}$ is a value of threshold for R measure that allows to make definite conclusion about very strong rhythm. The conclusion can be made only if k_R≧k_RD, where k_RD is a number of the standard intervals that is enough for this decision.

Other threshold values for the confident rhythm, for the hesitating rhythm, and for the uncertain rhythm are as follows: $R_{up}$, $R_{med}$, $R_{low}$, correspondingly. The following threshold values were experimentally defined for the preferred embodiment:

$R_{def}=2.50$, $R_{up}=1.00$, $R_{med}=0.75$, $R_{low}=0.5$.

If some vagueness exists: $D_{low}<D<D_{up}$, and the rhythm criteria, the harmony criteria, and the noise-criteria in certain combinations of conditions do not give a positive solution then it is possible to declare only that this is <<undetermined type>>.

The following threshold values were experimentally defined for the drag out parameter:

$D_{updef}=0.890$, $D_{up}=0.887$, $D_{low}=0.700$

The performed experiments show that the above-mentioned combined usage of criteria based on tail and drag out characteristics significantly decreases the vagueness zone for audio segments classification and together with the rhythm criteria, the harmony criteria, and the noise-criteria minimizes number of the classification errors.

Each class of sound-stream corresponds to a region in parameters space. Because of the multiplicity of these classes, the regions can have non-linear boundaries and be not simple-connected. If the parameters characterizing current sound segment are located inside the mentioned region, then a classifying the segment decision is produced. The Conclusion Generator unit 80 is implemented as a decision table. The main task of the decision table construction is aimed to coverage of classification regions by a set of conditions, combinations when the required decision is formed. So, the operation of the Conclusion Generator unit is the sequential check of the ordered list of the certain conditions' combinations. If conditions' combination is true, the corresponding decision is taken and the Boolean flag 'EndAnalysis' is set. Thus flag indicates that analysis process is complete. The method for distinguishing speech from music according to the invention can be realized both in software and in hardware using integral circuits. The logic of the preferred embodiment of the decision table is shown in FIG. 6.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for distinguishing speech from music in a digital audio signal in real time for the sound segments that have been segmented from an input signal of the digital sound processing systems by means of a segmentation unit on the base of homogeneity of their properties, the method comprising the steps of:

(a) framing an input signal into sequence of overlapped frames by a windowing function;

(b) calculating frame spectrum for every frame by FFT transform;

(c) calculating segment harmony measure on base of frame spectrum sequence;

(d) calculating segment noise measure on base of the frame spectrum sequence;

(e) calculating segment tail measure on base of the frame spectrum sequence;

(f) calculating segment drag out measure on base of the frame spectrum sequence;

(g) calculating segment rhythm measure on base of the frame spectrum sequence; and (h) making the distinguishing decision based on characteristics calculated.

2. The method according to claim 1, wherein the step (c) comprises the steps of:

(c-1) calculating a pitch frequency for every frame;

(c-2) estimating residual error of harmonic approximation of the frame spectrum by one-pitch harmonic model;

(c-3) concluding whether current frame is harmonic enough or not by comparing the estimating residual error with a predefined threshold; and (c-4) calculating segment harmony measure as the ratio of number of harmonic frames in analyzed segment to total number of frames.

3. The method according to claim 1, wherein the step (d) comprises the steps of:

(d-1) calculating autocorrelation function (ACF) of the frame spectrums for every frame;

(d-2) calculating mean value of ACF;

(d-3) calculating range of values of the ACF as difference between its maximal and minimal values;

(d-4) calculating ACF ratio of the mean value of the ACF to the range of values of the ACF;

(d-5) concluding whether current frame is noised enough or not by comparing the ACF ratio with the predefined threshold; and (d-6) calculating segment noise measure as a ratio of number of noised frames in the analyzed segment to the total number of frames.

4. The method according to claim 1, wherein the step (d) comprises the steps of:

(d-1) calculating autocorrelation function (ACF) of frame spectrums for every frame;

(d-2) calculating mean value of the ACF;

(d-3) calculating range of values of the ACF as difference between its maximal and minimal values;

(d-4) calculating ACF ratio of the mean value of the ACF to the range of values of the ACF;

(d-5) concluding whether current frame is noised enough or not by comparing the ACF ratio with a predefined threshold; and (d-6) calculating segment noise measure as the ratio of the number of noised frames in analyzed segment to total number of frames.

5. The method according claim 1, wherein the step (f) comprises the steps of:

(f-1) building horizontal local extremum map on base of spectrogram by means of sequence of elementary comparisons of neighboring magnitudes for all frame spectrums;

(f-2) building lengthy quasi lines matrix, containing only quasi-horizontal lines of length not less than a predefined threshold, on base of the horizontal local extremum map, (f-3) building array containing column's sum of absolute values computed for elements of the lengthy quasi lines matrix;

(f-4) concluding whether current frame is dragging out enough or not by comparing corresponding component of the array with the predefined threshold; and (f-5) calculating segment drag out measure as ratio of number of all dragging out frames in the current segment to total number of frames.

6. The method of claim 5, wherein the step (f-4) is performed as comparing a corresponding component of the array with the mean value of dragging out level obtained for a standard white noise signal.

7. The method of claim 1, wherein the step (g) comprises steps of:

(g-1) dividing current segment into set of overlapped intervals of fixed length;

(g-2) determining of interval rhythm measures for interval of the fixed length; and (g-3) calculating segment rhythm measure as an averaged value of the interval rhythm measures for all intervals of the fixed length containing in the current segment.

8. The method of claim 7, wherein the step (g-2) comprises the steps of:

(g-2-i) dividing the frame spectrum of every frame, belonging to an interval, into predefined number of bands, and calculating the bands' energy for every band of the frame spectrum;

(g-2-ii) building functions of spectral bands' energy as functions of frame number for every band, and calculating autocorrelation functions (ACFs) of all the functions of the spectral bands' energy;

(g-2-iii) smoothing all the ACFs by means of short ripple filter;

(g-2-iv) searching all peaks on every smoothed ACFs and evaluating altitude of peaks by means of an evaluating function depending on a maximum point of peak, an interval of ACF increase and an interval of ACF decrease;

(g-2-v) truncating all the peaks having the altitude less than the predefined threshold;

(g-2-vi) grouping peaks in different bands into groups of peaks accordingly their lag values equality, and evaluating the altitudes of the groups of peaks by means of an evaluating function depending on altitudes of all peaks, belonging to the group of peaks;

(g-2-vii) truncating all the groups of peaks not having the correspondent groups of peaks with double lag value, and calculating dual rhythm measure for every couple of the groups of peaks as the mean value of the altitude of a group of peaks and the altitude of the correspondent group of peaks with double lag; and (g-2-viii) determining interval rhythm measures as a maximal value among all the dual rhythm measures for every couple of the groups of peaks calculated for this interval.

9. The method according to claim 1, wherein the step (h) is performed as the sequential check of the ordered list of the certain conditions' combinations expressed in terms of logical forms comprising comparisons of segment harmony measure, segment noise measure, segment tail measure, segment drag out measure, segment rhythm measure with predefined set of thresholds until one of conditions' combinations become true and the required conclusion is made.

10. A system for distinguishing speech from music in a digital audio signal in real time for sound segments that have been segmented from an input digital signal by means of a segmentation unit on base of homogeneity of their properties, the system comprising:

a processor for dividing an input digital speech signal into a plurality of frames;

an orthogonal transforming unit for transforming every frame to provide spectral data for the plurality of frames;

a harmony demon unit for calculating segment harmony measure on base of spectral data;

a noise demon unit for calculating segment noise measure on base of the spectral data;

a tail demon unit for calculating segment tail measure on base of the spectral data;

a drag out demon unit for calculating segment drag out measure on base of the spectral data;

a rhythm demon unit for calculating segment rhythm measure on base of the spectral data;

a processor for making distinguishing decision based on characteristics calculated.

11. The system according to claim 10, wherein the harmony demon unit further comprises:

a first calculator for calculating a pitch frequency for every frame;

an estimator for estimating a residual error of harmonic approximation of frame spectrum by one-pitch harmonic model;

a comparator for comparing the estimated residual error with the predefined threshold; and a second calculator for calculating the segment harmony measure as the ratio of number of harmonic frames in analyzed segment to total number of frames.

12. The system according to claim 10, wherein the noise demon unit further comprises:

a first calculator for calculating an autocorrelation function (ACF) of frame spectrums for every frame;

a second calculator for calculating mean value of the ACF;

a third calculator for calculating range of values of the ACF as difference between its maximal and minimal values;

a fourth calculator of ACF ratio of the mean value of the ACF to range of values of the ACF;

a comparator for comparing an ACF ratio with a predefined threshold; and a fifth calculator for calculating segment noise measure as ratio of number of noised frames in analyzed segment to total number of frames.

13. The system according to claim 10, wherein the tail demon unit further comprises:

a first calculator for calculating a modified flux parameter as ratio of Euclid norm of the difference between spectrums of two adjacent frames to Euclid norm of their sum;

a processor for building histogram of values of the modified flux parameter calculated for every couple of two adjacent frames in current segment; and a second calculator for calculating segment tail measure as sum of values along right tail of the histogram from a predefined bin number to the total number of bins in the histogram.

14. The system of claim 10, wherein the drag out demon unit further comprises:

a first processor for building horizontal local extremum map on base of spectrogram by means of sequence of elementary comparisons of neighboring magnitudes for all frame spectrums;

a second processor for building lengthy quasi lines matrix, containing only quasi-horizontal lines of length not less than a predefined threshold, on base of the horizontal local extremum map;

a third processor for building array containing column's sum of absolute values computed for elements of the lengthy quasi lines matrix;

a comparator for comparing the column's sum corresponding to every frame with the predefined threshold; and a fourth calculator for calculating segment drag out measure as ratio of number of all dragging out frames in current segment to total number of frames.

15. The system according to claim 10, wherein the rhythm demon unit further comprises:

a first processor for dividing current segment into set of overlapped intervals of a fixed length;

a second processor for determining of interval rhythm measures for interval of the fixed length; and a calculator for calculating segment rhythm measure as an averaged value of the interval rhythm measures for all the intervals of the fixed length containing in the current segment.

16. The system according to claim 15, wherein the second processor comprises:

a first processor unit for dividing the frame spectrum of every frame, belonging to the said interval, into predefined number of bands, and calculating the bands' energy for every said band of the frame spectrum;

a second processor unit for building the functions of the spectral bands' energy as functions of frame number for every said band, and calculating the autocorrelation functions (ACFs) of all the functions of the spectral bands' energy;

a ripple filter unit for smoothing all the ACFs;

a third processor unit for searching all peaks on every smoothed ACFs and evaluating the altitude of the peaks by means of an evaluating function depending on a maximum point of the peak, an interval of ACF increase and an interval of ACF decrease;

a first selector unit for truncating all the peaks having the altitude less than the predefined threshold;

a fourth processor unit for grouping peaks in different bands into the groups of peaks accordingly their lag values equality, and evaluating the altitudes of the groups of peaks by means of an evaluating function depending on altitudes of all peaks, belonging to the group of peaks;

a second selector unit for truncating all the groups of peaks not having the correspondent groups of peaks with double lag value, and calculating dual rhythm measure for every couple of the groups of peaks as mean value of the altitude of a group of peaks and the altitude of the correspondent group of peaks with double lag; and a fifth processor unit for determining of the interval rhythm measures as a maximal value among all dual rhythm measures for every couple of the groups of peaks calculated for this interval.

17. The system according to claim 10, wherein the processor making distinguishing decision is implemented as decision table containing ordered list of certain conditions' combinations expressed in terms of logical forms comprising comparisons of segment harmony measure, the segment noise measure, the segment tail measure, the segment drag out measure, the segment rhythm measure with predefined set of thresholds until one of the conditions' combinations become true and required conclusion is made.

* * * * *